US008417142B2

(12) United States Patent
Furuichi et al.

(10) Patent No.: US 8,417,142 B2
(45) Date of Patent: Apr. 9, 2013

(54) IMAGE FORMING APPARATUS HAVING DEVELOPING DEVICE COOLING MECHANISM, AND CONTROL METHOD THEREFOR

(75) Inventors: Yuusuke Furuichi, Ikeda (JP); Nobuhiko Kita, Suita (JP); Sei Onuma, Ikeda (JP); Ryoh Idehara, Kawanishi (JP); Kazuyoshi Kondo, Toyonaka (JP); Genta Hagiwara, Ikeda (JP); Kaoru Tada, Toyonaka (JP)

(73) Assignee: Ricoh Company, Limited, Tokyo (JP)

( * ) Notice: Subject to any disclaimer, the term of this patent is extended or adjusted under 35 U.S.C. 154(b) by 449 days.

(21) Appl. No.: 12/431,916

(22) Filed: Apr. 29, 2009

(65) Prior Publication Data

US 2009/0285588 A1 Nov. 19, 2009

(30) Foreign Application Priority Data

May 19, 2008 (JP) ..... 2008-130912

(51) Int. Cl.
*G03G 21/20* (2006.01)

(52) U.S. Cl.
USPC ..... 399/94

(58) Field of Classification Search ..... 399/27, 399/30, 61–64, 92, 94
See application file for complete search history.

(56) References Cited

U.S. PATENT DOCUMENTS

2005/0089338 A1* 4/2005 Hoshi et al. ..... 399/27
2007/0246638 A1 10/2007 Idehara et al.
2008/0007935 A1 1/2008 Kondo et al.
2008/0063425 A1 3/2008 Idehara et al.
2008/0253796 A1 10/2008 Idehara et al.
2008/0279585 A1 11/2008 Furuichi et al.
2008/0292356 A1 11/2008 Furuichi et al.
2009/0074446 A1 3/2009 Idehara et al.
2009/0074456 A1 3/2009 Tada et al.
2009/0080937 A1 3/2009 Kita et al.

FOREIGN PATENT DOCUMENTS

JP 9-212066 8/1997
JP 2000-250381 9/2000
JP 2006-58724 3/2006

(Continued)

OTHER PUBLICATIONS

U.S. Appl. No. 12/285,524, filed Oct. 8, 2008.

(Continued)

*Primary Examiner* — Walter L Lindsay, Jr.
*Assistant Examiner* — Milton Gonzales
(74) *Attorney, Agent, or Firm* — Oblon, Spivak, McClelland, Maier & Neustadt, L.L.P.

(57) ABSTRACT

An image forming apparatus includes a latent image carrier, a latent image forming unit to form an electrostatic latent image on the latent image carrier, at least one developing device disposed to contact the latent image carrier to develop the latent image with developer stored therein, a cooling mechanism including at least one cooling device disposed close to the developing device to cool the developing device, a developer amount detector electrically connected to the developing device to detect an amount of the developer remaining in the developing device, and a cooling mechanism controller connected to the cooling mechanism to change a cooling power of the cooling mechanism according to a detection result generated by the developer amount detector. The developing device includes a rotary member whose shaft is rotationally supported by at least one bearing and is not to be supplied with new developer while any developer remains therein.

9 Claims, 8 Drawing Sheets

FOREIGN PATENT DOCUMENTS

| | | | | |
|---|---|---|---|---|
| JP | 2006-133279 | | | 5/2006 |
| JP | 2006138910 | A | * | 6/2006 |
| JP | 2007-108252 | A | | 4/2007 |
| JP | 2007298636 | A | * | 11/2007 |

OTHER PUBLICATIONS

Office Action issued Jul. 6, 2012 in Japanese Patent Application No. 2008-130912.

* cited by examiner

IMAGE FORMING APPARATUS HAVING DEVELOPING DEVICE COOLING MECHANISM, AND CONTROL METHOD THEREFOR

CROSS-REFERENCE TO RELATED APPLICATIONS

This patent specification claims priority from Japanese Patent Application No. 2008-130912, filed on May 19, 2008 in the Japan Patent Office, the entire contents of which are hereby incorporated by reference herein.

BACKGROUND OF THE INVENTION

1. Field of the Invention

The present invention generally relates to an image forming apparatus such as a copier, a printer, a facsimile machine, and the like, and a control method therefor.

2. Discussion of the Background

In general, an electrophotographic image forming apparatus such as a copier, a printer, a facsimile machine, and a multifunction machine including at least two of these functions includes a writing unit for forming electrostatic latent images on an image carrier, a developing device for developing the latent images with developer such as toner, a transfer member for transferring the developed image onto a sheet of recording media, and a fixer for fixing the image on the sheet.

Typically, several components of the image forming apparatus, such as the writing unit, the developing device, and the fixer, generate heat. Therefore the image forming apparatus further includes a cooling fan to generate airflow to cool such components and a surrounding area.

For example, in the developing device, when a developer transport member such as a transport screw agitates and transports the developer, heat is generated due to friction between the developer transport member and the developer, which can cause the developer in the developing device to deteriorate. Further, if the temperature of the developing device itself and in the surrounding area rises excessively, it can cause a malfunction of the image forming apparatus and/or imaging failure. Therefore, typically a cooling fan is provided close to the developing device to inhibit an excessive rise in temperature of the developing device and in the surrounding area.

For example, one known image forming apparatus controls velocity (rotational frequency) of the cooling fan to cool the developing device and an area surrounding it according to ambient temperature. Because the temperature of the developing device and in the surrounding area is liable to rise when ambient temperature is higher, this image forming apparatus increases the velocity of the cooling fan when ambient temperature is higher and reduces the velocity of the cooling fan when ambient temperature is lower so as to reduce noise of as well as energy consumed by the cooling fan.

Heat generation in the developing device is described below in further detail.

During image formation, as the developer transport member agitates and transports the developer in the developing device, the developer tends to adhere to axis bearings that rotationally support a rotational axis of the developer transport member. Over time, the developer accumulates on the axis bearing, and clogs a gap between the axis bearing and the rotational axis of the developer transport member, thus hindering rotation of the developer transport member. In this state, the developer transport member slidingly contacts the axis bearing via the developer, generating frictional heat, which causes the temperature around the axis bearing to rise, and accordingly the temperature rises in the developing device and in the surrounding area.

However, in the above-described known image forming apparatus, as long as the ambient temperature does not change, the velocity of the cooling fan remains constant regardless of whether or not the above-described frictional heat is generated. That is, it is likely that the velocity of the cooling fan is set to a sufficiently high value so as to restrict a rise in the temperature of the developing device and in the surrounding area even when frictional heat is generated, which means the velocity is excessively high while frictional heat is not yet generated.

Therefore, during a period from when use of a new developing device is started until the developer has accumulated on the axis bearing of the developer transport member over time, noise of as well as energy consumed by the cooling fan are unnecessarily large.

To cope with the inconveniences described above, there is a need to control the cooling fan efficiently, which known image forming apparatuses fail to do.

SUMMARY OF THE INVENTION

In view of the foregoing, in one illustrative embodiment of the present invention, an image forming apparatus includes a latent image carrier, a latent image forming unit to form an electrostatic latent image on the latent image carrier, at least one developing device disposed to contact the image carrier to develop the latent image on the image carrier with developer contained therein, a cooling mechanism including at least one cooling device disposed close to the developing device to cool the developing device, a developer amount detector electrically connected to the developing device to detect an amount of the developer remaining in the developing device, and a cooling mechanism controller connected to the cooling mechanism to change a cooling power of the cooling device according to a detection result generated by the developer amount detector. Each developing device includes at least one rotary member whose shaft is rotationally supported by at least one bearing. A predetermined amount of developer is preliminarily contained in the developing device, and new developer is not to be supplied to the developing device with while any developer remains therein.

Another illustrative embodiment of the present invention provides a control method for the image forming apparatus described above. The control method includes detecting an amount of the developer remaining in the developing device, and setting a cooling power of the cooling mechanism according to a detected amount of the developer remaining in the developing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
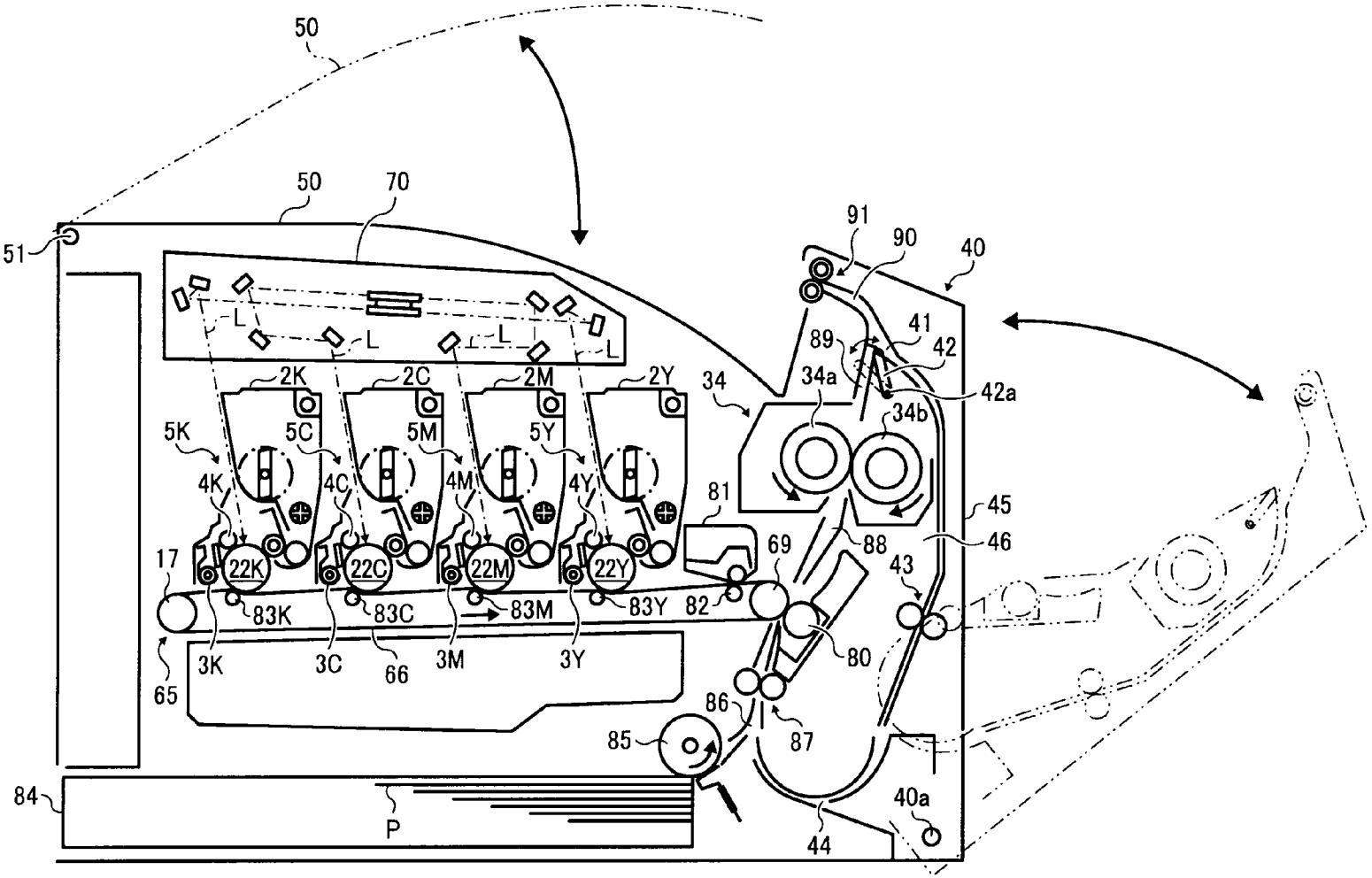
FIG. 1 illustrates a schematic configuration of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an example embodiment of the present invention is described.

FIG. 1 illustrates a schematic configuration of the image forming apparatus that in the present embodiment is an electronographic multicolor printer from a front side. A front surface and a back surface of paper on which FIG. 1 is drawn are respectively the front side of and a back side of the image forming apparatus.

Referring to FIG. 1, the image forming apparatus includes four process cartridges 5Y, SM, 5C, and 5K serving as image forming units for forming yellow, magenta, cyan, and black images, respectively. The process cartridges 5Y, SM, 5C, and 5K have a similar configuration except the color of developers (toners) used to form images. It is to be noted that reference characters Y, M, C, and B represent yellow, magenta, cyan, and black, respectively, and may be omitted in the description below when color discrimination is not required.

Each process cartridge 5 includes a drum-shaped photoreceptor 22 serving as a latent image carrier, a charger 4 to charge a surface of the photoreceptor 22, a developing device 2 to develop an electrostatic latent image formed on the photoreceptor 22, and a photoreceptor cleaner 3 to clean the photoreceptor 22. Each process cartridge 5 is detachably attachable to the image forming apparatus and can be replaced when its life expires. Thus, consumables in the process cartridge 5 can be replaced simultaneously.

In the present embodiment, the developer is one-component developer including toner, and the developing device 2 is replaced when the toner contained therein has been consumed.

In FIG. 1, a writing unit 70 serving as a latent image forming unit is disposed above the process cartridges 5, and a transfer unit 65 including an intermediate transfer belt 66 is disposed beneath the process cartridges 5. The writing unit 70 directs laser beams L onto the surfaces of the photoreceptors 22 according to image information.

In each process cartridge 5, the photoreceptor 22 is rotated by a driving unit, not shown, and the charger 4 charges the surface of the photoreceptor 22 uniformly. Then, the writing unit 70 scans the surface of each photoreceptor 22 with the laser beam L that is emitted from a laser diode, not shown. More specifically, the writing unit 70 directs the laser beams L onto the respective photoreceptors 22 using multiple optical lenses and mirrors while deflecting the laser beams L with a polygon mirror in a main scanning direction. Alternatively, the writing unit 70 can direct beams emitted from multiple LEDs (Light-Emitting Diodes) included in an LED array onto the respective photoreceptors 22.

Thus, electrostatic latent images for yellow, magenta, cyan, and black are formed on the respective photoreceptors 22.

Subsequently, in each process cartridge 5, the developing device 2 develops the latent image with toner into a toner image. Thus, the process cartridges 5Y, 5M, 5C, and 5K form yellow, magenta, cyan, and black images on the respective photoreceptors 22Y, 22M, 22C, and 22K in that order.

These toner images are then transferred from the photoreceptors 22 onto the intermediate transfer belt 66 that rotates counterclockwise in FIG. 1, after which the photoreceptor cleaner 3 in each process cartridge 5 removes any toner remaining on the photoreceptor 22. Each process cartridge 5 further includes a discharger, not shown, that removes electricity remaining on the photoreceptor 22 after the photoreceptor cleaner 3 cleans the surface of the photoreceptor 22, thereby initializing the surface of the photoreceptor 22 as preparation for subsequent image formation.

In the transfer unit 65, the intermediate transfer belt 66 is looped around a driving roller 17, a driven roller 69, four primary transfer rollers 83Y, 83M, 83C, and 83K serving as transfer bias members. The driving roller 17 is driven by a driving source, not shown, and rotates the intermediate transfer belt 66.

The transfer unit 65 further includes a secondary transfer roller 80 disposed outside the loop of the intermediate transfer belt 66, a belt cleaner 81 that contacts the outer surface of the intermediate transfer belt 66, and a backup roller 82 disposed to face the belt cleaner 81 via the intermediate transfer belt 66.

The primary transfer rollers 83 sandwich the intermediate transfer belt 66 together with the respective photoreceptors 22. Thereby, primary transfer nips are formed between an outer surface of the intermediate transfer belt 66 and the respective photoreceptors 22.

Each primary transfer roller 83 receives primary transfer bias from a transfer bias power source, not shown, and thus a transfer electrical field is formed between the electrostatic latent image formed on the photoreceptor 22 and the primary transfer roller 83. Alternatively, transfer chargers or transfer brushes can be used as the transfer bias members instead of the primary transfer rollers 83.

More specifically, as the respective photoreceptors 22 rotate, the yellow, magenta, cyan, and black toner images formed thereon sequentially reach the respective primary transfer nips, where the toner images are primarily transferred from the respective photoreceptors 22 onto the intermediate transfer belt 66 with an effect of the transfer electrical field and nip pressure. The yellow, magenta, cyan, and black toner images are superimposed one on another on the intermediate transfer belt 66 in that order, forming a multicolor toner image thereon.

The secondary transfer roller 80 sandwiches the intermediate transfer belt 66 together with the driven roller 69, thus forming a secondary transfer nip between the secondary transfer roller 80 and the outer surface of the intermediate transfer belt 66. The secondary transfer roller 80 receives secondary transfer bias from a transfer bias source, not shown, which forms a secondary transfer electrical field between the secondary transfer roller 80 and the driven roller 69 that is grounded.

The image forming apparatus further includes a sheet cassette 84, disposed beneath the transfer unit 65, that contains multiple sheets P of recording media, a feed roller 85, a sheet feed path 86, and a post-transfer path 88. A pair of registration rollers 87 is disposed close to an end of the sheet feed path 86.

The sheet cassette 84 is slidable into and out of a housing of the image forming apparatus. The feed roller 85 contacts the sheet P on the top in the sheet cassette 84 and feeds the sheet P to the sheet feed path 86 by rotating counterclockwise in FIG. 1.

The registration rollers 87 stop rotating with a leading edge portion (hereinafter also "first edge portion") of the sheet P sandwiched therebetween and then forward the sheet P to the secondary transfer nip, timed to coincide with the multicolor toner on the intermediate transfer belt 66.

When the sheet P laps over the multicolor toner image on the intermediate transfer belt 66 in the secondary transfer nip, the multicolor toner image is secondarily transferred onto a first surface of the sheet P with an effect of the secondary transfer electrical field and nip pressure. On the sheet P, white is added to the multicolor image, making the image into a natural-colored image, which is so-called a full-color image, which is yet unfixed on the sheet P. Then, the sheet P leaves both the secondary transfer roller 80 and the intermediate transfer belt 66 through curvature separation. The sheet P is then transported along the post-transfer path 88.

After the toner image is thus transferred from the intermediate transfer belt 66, the belt cleaner 81 removes any toner remaining on the intermediate transfer belt 66. The backup roller 82 supports the intermediate transfer belt 66 from its inner surface to facilitate cleaning of the intermediate transfer belt 66.

The image forming apparatus further includes a fixer 34 disposed downstream from the secondary transfer roller 80 in a direction in which the sheet P is transported (hereinafter "sheet transport direction"), a post-fixing path 89, a discharge path 90, a pair of discharge rollers 91, a hinged sheet reverse unit 40 that is a right side edge portion of the image forming apparatus in FIG. 1, and a hinged upper cover 50.

The fixer 34 includes a fixing roller 34*a* and a pressure roller 34*b* that rotates while pressing against the fixing roller 34*a*, forming a fixing nip therebetween. The fixing roller 34*a* includes a heat source, not shown, such as a halogen heater. The sheet P is sandwiched in the fixing nip so that the first surface of the sheet P on which the unfixed toner image is formed closely contacts the fixing roller 34*a*, and the toner image is fixed on the sheet P with heat and pressure.

After passing through the fixing nip, the sheet P is transported along the post-fixing path 89 to a branch point provided with a switch pawl 42 that can block an end portion of the post-fixing path 89 to guide the sheet P to a first reverse path 41 leading to the sheet reverse unit 40 by pivoting about a rotation axis 42*a*. More specifically, when the fixer 34 sends out the sheet P, the switch pawl 42 is at a position indicated by a solid line in FIG. 1 to lead the sheet P from the post-fixing path 89 to the discharge path 90. The sheet P is transported along the discharge path 90 to the discharge rollers 91, which sandwich the leading edge portion of the sheet P therebetween.

The image forming apparatus according to the present embodiment can accommodate both a single-side printing in which an image is formed on only one side (first surface) of the sheet P and a duplex printing in which images are formed on both sides of the sheet P. Either single-side printing or duplex printing can be set according to an input operation of a user through an operation panel, not shown, provided with numeric keys or control signals from a computer.

When single-side printing is selected, after the image is fixed on its first surface, the sheet P is discharged by the discharge rollers 91 onto an upper surface of the upper cover 50 serving as a stack table.

By contrast, in duplex printing, the sheet P is transported along the discharge path 90 with the leading edge portion thereof sandwiched between the discharge rollers 91 until a trailing edge portion of the sheet P has passed through the post-fixing path 89. It is to be noted that the leading edge portion and the trailing edge portion of the sheet P in the sheet transport direction are hereinafter referred to as a first edge portion and a second edge portion, respectively.

Subsequently, the switch pawl 42 pivots about the rotation axis 42*a* to a position indicated by a dotted line shown in FIG. 1, thereby blocking the end portion of the post-fixing path 89. Simultaneously or substantially simultaneously, the discharge rollers 91 start reverse rotation, forwarding the sheet P to the first reverse path 41 from its second edge portion.

The sheet reverse unit 40 and turning the sheet P over therein are described in further detail below with reference to FIG. 1.

The hinged sheet reverse unit 40, that is, the right side edge portion of the image forming apparatus in FIG. 1, can rotate about a rotation axis 40*a* down, exposing an interior of the image forming apparatus. The sheet reverse unit 40 further includes a pair of transport rollers 43, a second reverse path 44, an outer cover 45, and a rotary member 46.

The sheet P that is forwarded by reverse rotation of the discharge rollers 91 is transported downward in FIG. 1 along the first reverse path 41 in the sheet reverse unit 40. After the sheet P passes between the transport rollers 43, the sheet P enters the second reverse path 44 that is curved like an arc, where the sheet P is reversed while being transported upward in FIG. 1.

Subsequently, the sheet P reversed in the sheet reverse unit 40 is again transported through the sheet feed path 86 to the second transfer nip, where another image is transferred onto a second surface of the sheet P. The sheet P is further transported through the post-transfer path 88, the fixer 34, the post-fixing path 89, and the discharge path 90 and then discharged by the discharge rollers 91 outside the image forming apparatus.

The outer cover 45 of the sheet reverse unit 40 can rotate around the rotation axis 40*a* provided on the housing of the image forming apparatus. When the outer cover 45 is pulled down, both the outer cover 45 and the rotary member 46 held therein open to expose the interior of the image forming apparatus as indicated by dotted lines in FIG. 1.

In other words, the sheet feed path 86, the secondary transfer nip, the post-transfer path 88, the fixing nip, the post-fixing path 89, the discharge path 90, which are formed between a main body of the image forming apparatus and the sheet reverse unit 40, can be respectively divided into two in a vertical direction in FIG. 1, that is, can be exposed to facilitate removal of a jammed sheet therefrom.

Further, the outer cover 45 includes a rotation axis, not shown, about which the rotary member 46 can rotate when the outer cover 45 is opened. When the rotary member 46 is opened with respect to the outer cover 45, the first reverse path 41 and the second reverse path 44 can be respectively divided into two, being exposed to facilitate removal of a jammed sheet therefrom.

The upper cover 50 is rotatable about a shaft 51 counterclockwise in FIG. 1 as indicated by an arrow, exposing an upper portion of the image forming apparatus relatively widely. In this state, the process cartridges 5 can be removed from or installed in the image forming apparatus from above.

In the image forming apparatus described above, because the developing units 2 generate heat while agitating and transporting the developer in image formation, the image forming unit according to present embodiment further includes a cooling mechanism, which is described below with reference to FIGS. 2 and 3.

Figure 2:
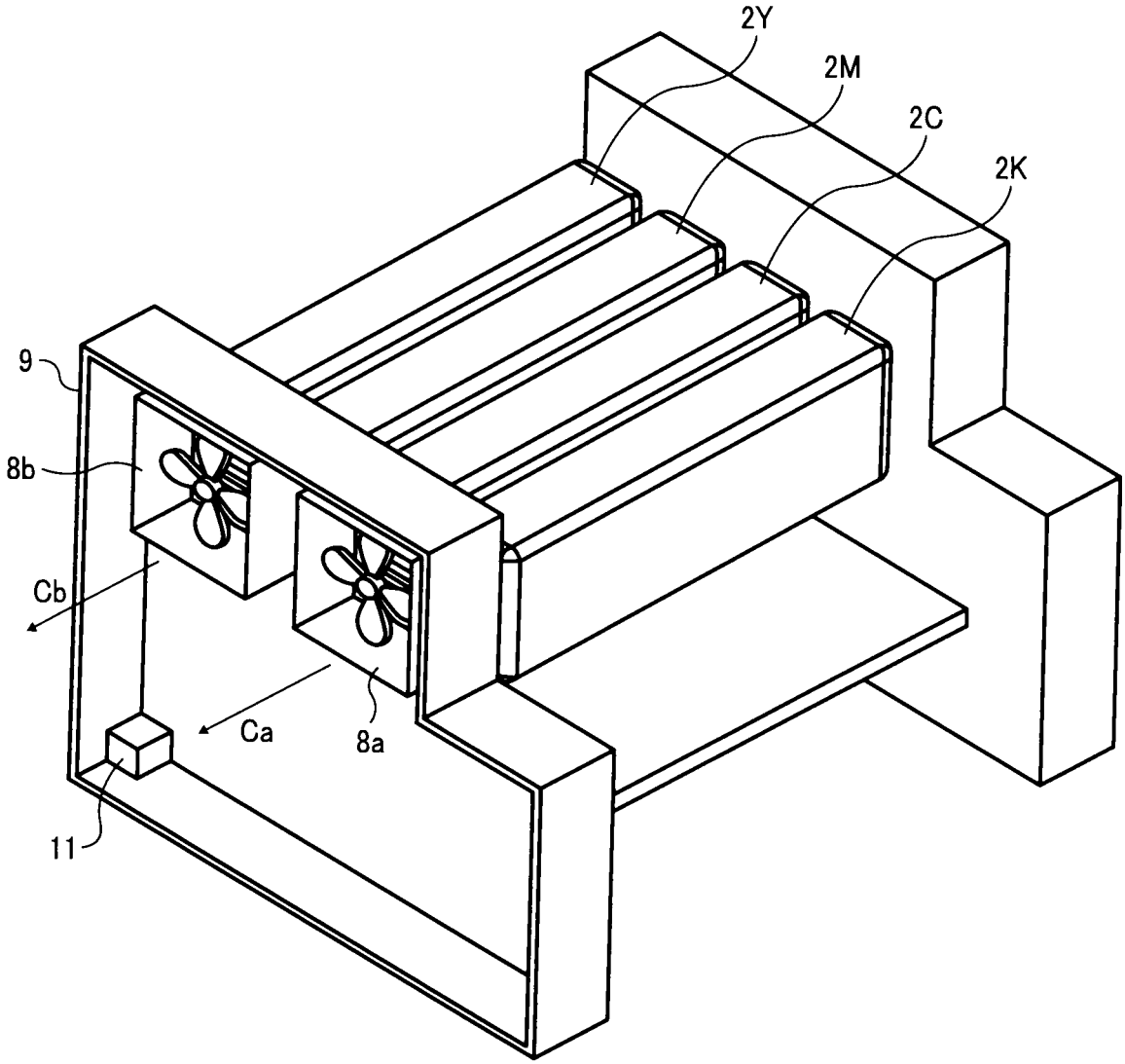
FIG. 2 is a perspective view illustrating a main part of the image forming apparatus shown in FIG. 1 viewed from the back side.

FIG. 2 is a perspective view illustrating a main part of the image forming apparatus shown in FIG. 1 viewed from the back side.

Referring to FIG. 2, the image forming apparatus further includes the cooling mechanism configured to cool the developing devices 2 and a temperature sensor 11 to detect temperature around the image forming apparatus (hereinafter "ambient temperature"). The cooling mechanism includes axial-flow fans 8*a* and 8*b*, each serving as a cooling device, attached to a frame structure 9. The axial-flow fans 8*a* and 8*b* exhaust air in a direction indicated by arrow Ca and Cb, and a controller 13 shown in FIG. 6 controls their rotation frequency (rotation velocity). During normal image formation, the controller 13 sets the axial-flow fans 8*a* and 8*b* to a first cooling mode in which the axial-flow fans 8*a* and 8*b* rotates at a rotation frequency of 2200 rpm, for example, which is about half their full velocity. Thus, the controller 13 serves as a cooling mechanism controller.

Figure 3:
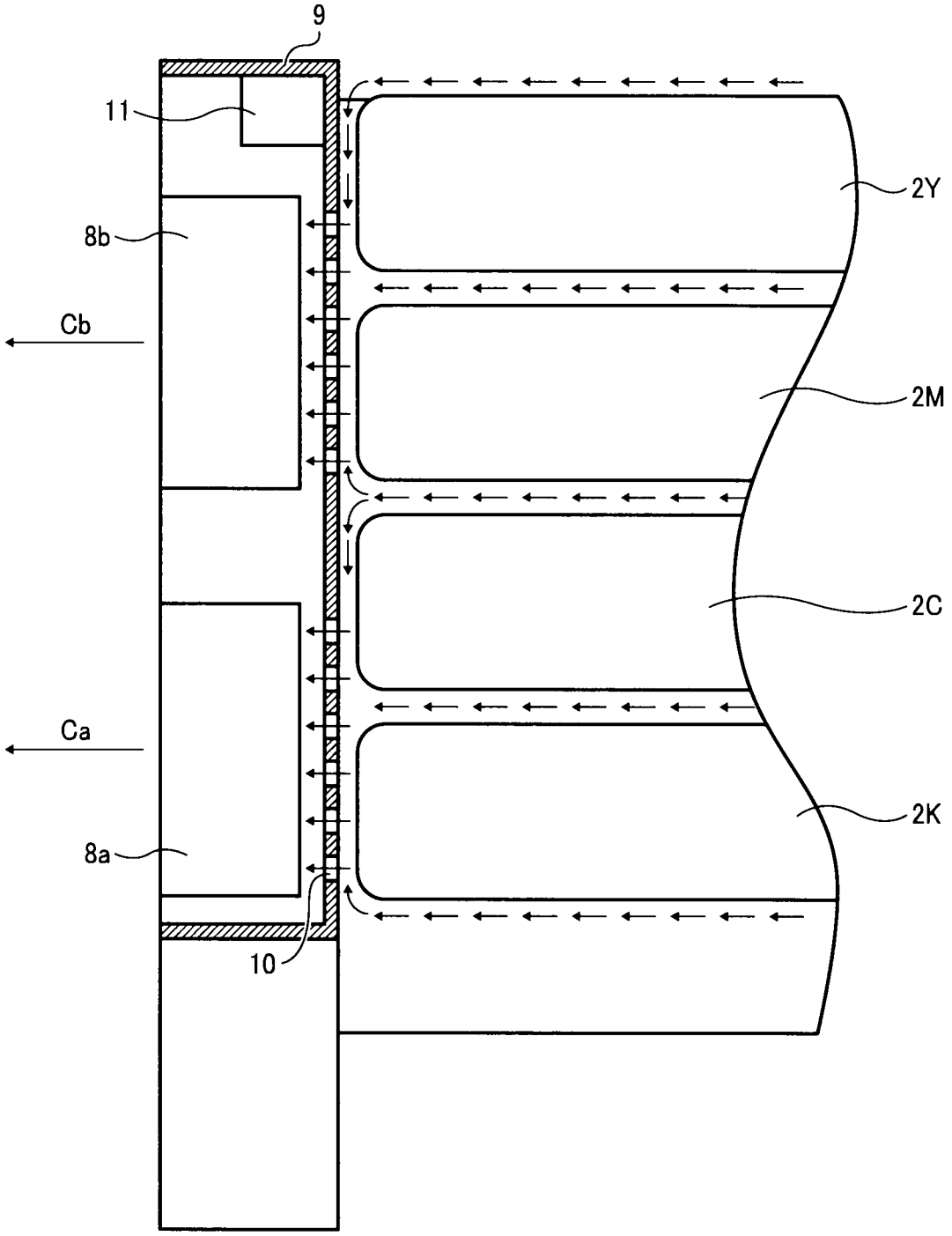
FIG. 3 is an overhead view illustrating axial-flow fans and surrounding area.

FIG. 3 illustrates the axial-flow fans 8*a* and 8*b* and an area surrounding them viewed from above.

As shown in FIG. 3, multiple holes 10 are formed in the frame structure 9, and heat around the developing devices 2Y, 2C, 2M, and 2K is dissipated through the holes 10 to the exterior of the image forming apparatus. The temperature sensor 11 should be disposed sufficiently away from those components, such as the writing unit 70, the developing devices 2, the fixer 34, the driving unit, and the power source, not shown, that generate heat so that its readings are not affected by heat generated in the image forming apparatus and ambient temperature can be detected accurately.

The developing device 2 is described in further detail below with reference to FIGS. 4 through 6.

Figure 4:
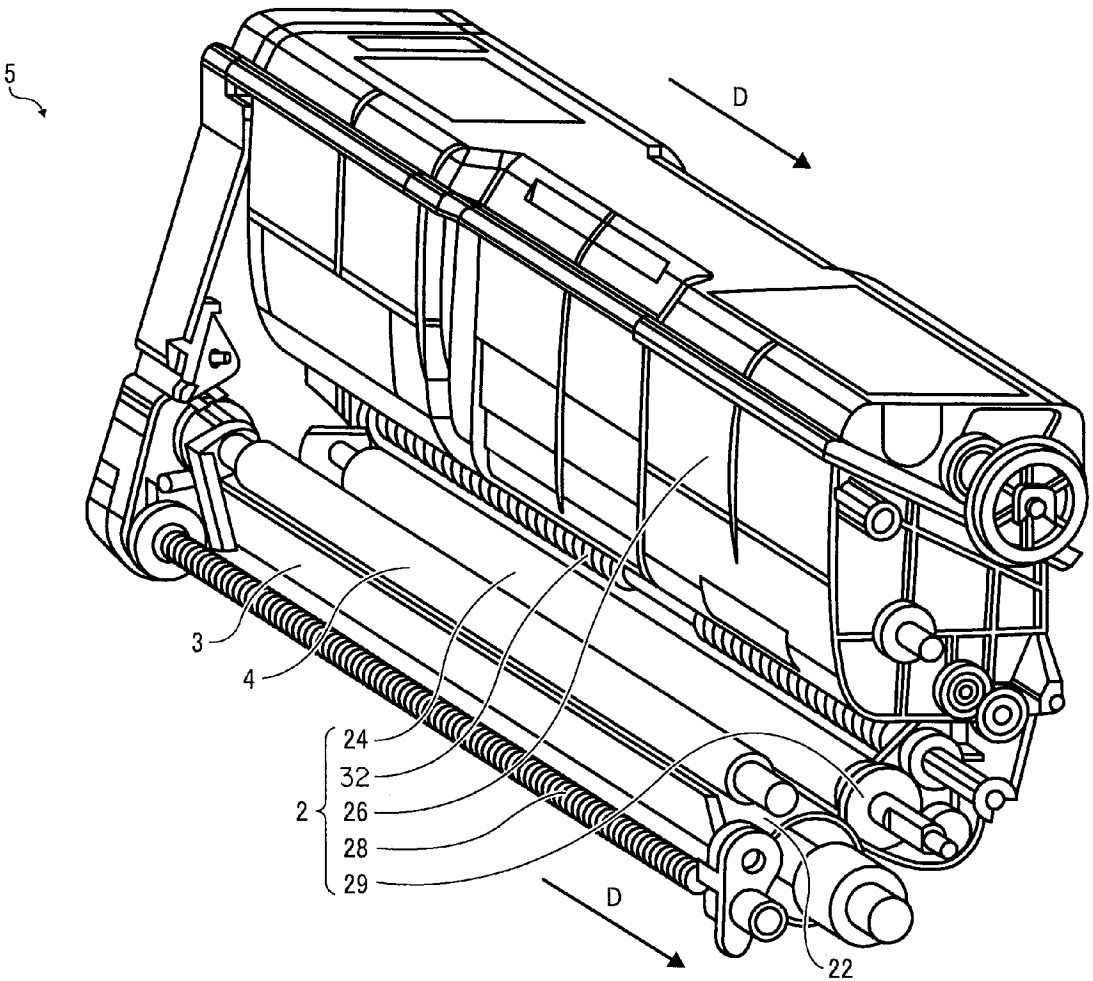
FIG. 4 is a perspective view illustrating a process cartridge including a developing device.
Figure 5:
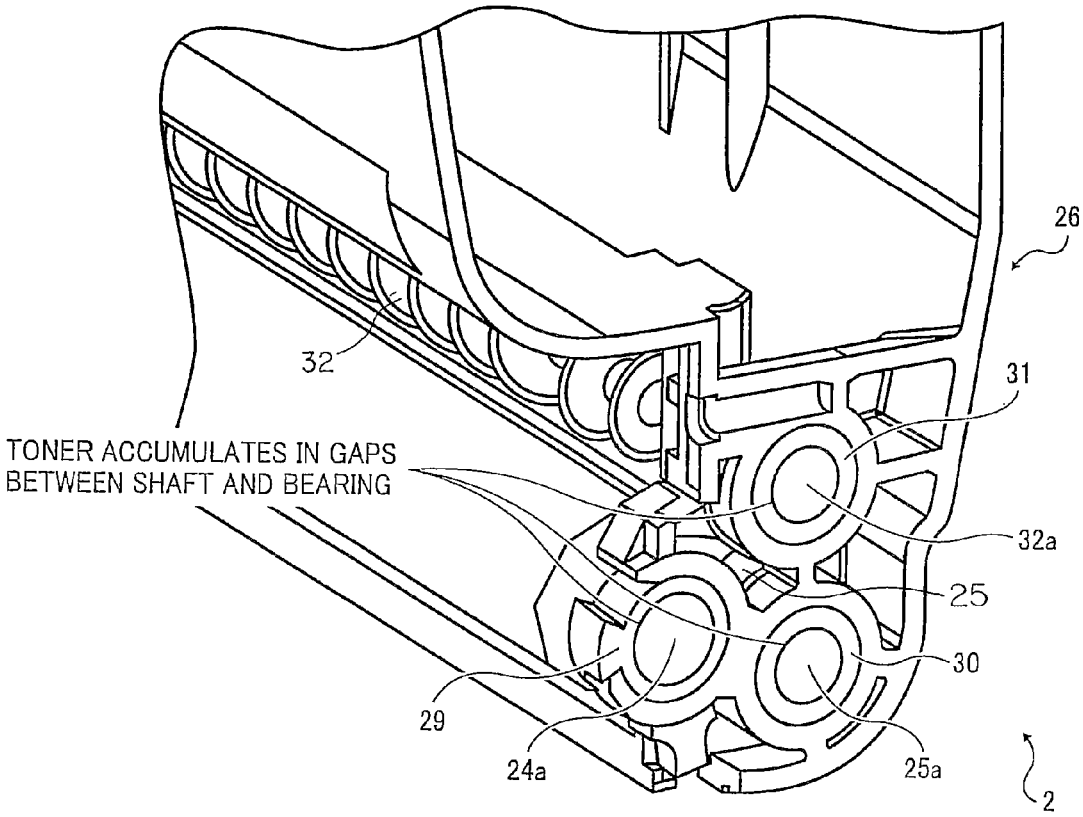
FIG. 5 is an enlarged view illustrating bearings that respectively support shafts of rotary members in the developing device shown in FIG. 4.

Referring to FIGS. 4 and 5, the developing device 2 includes a developing roller 24, a supply roller 25, a toner container 26 to contain both used toner and unused toner, and an agitation and transport screw 32. The process cartridge 5 further includes a toner transporter 28 to transport the toner removed from the photoreceptor 22 by the photoreceptor cleaner 3 to the toner container 26.

The developing roller 24 supplies the toner that is magnetically attracted to its surface to the photoreceptor 22, and an end portion of its shaft 24*a* is rotationally supported by a bearing 29. The supply roller 25 supplies the toner to the developing roller 24, and an end portion of its shaft 25*a* is rotationally supported by a bearing 30. The agitation and transport screw 32 transports the toner while agitating it, and an end portion of its shaft 32*a* is rotationally supported by a bearing 31.

Although not shown in FIGS. 4 and 5, end portions of the developing roller 24, the supply roller 25, and the agitation and transport screw 32 opposite the end portions supported by the respective bearings 29, 30, 31 are rotationally supported by respective bearings as well. Thus, the developing roller 24, the supply roller 25, and the agitation and transport screw 32 serve as rotary members whose shaft are rotationally supported by respective bearings.

The developing roller 24 contacts the supply roller 25, and the developing roller 24 and the supply roller 25 rotate in an identical direction. Thus, the toner is supplied from the supply roller 25 to the developing roller 24 and further to a development range that is a contact area between the developing roller 24 and the photoreceptor 22, where the toner adheres to the electrostatic latent image formed on the photoreceptor 22, developing it into a toner image. Because the developing roller 24 and the supply roller 25 rotate in an identical direction, frictional heat is generated.

As each of the developing roller 24, the supply roller 25, and the agitation and transport screw 32 transports the developer in each developing device 2 in image formation, the developer tends to accumulate in a gap between the shafts (24*a*, 25*a*, or 32*a*) and the bearings (29, 30, or 31) that rotationally support the shaft. When a certain amount of the developer has been consumed in image formation, that is, when an amount of the developer remaining in the developing device 2 is relatively small, the gap can be clogged with the developer, generating frictional heat between the shafts and the bearings via the developer. This is because a relatively large amount of toner has already been agitated and transported in the developing device 2, and accordingly, the amount of toner accumulated on the bearing can be relatively large. In other words, the amount of toner consumption substantially equals the amount of the toner that has been transported through the developing device 2 to the photoreceptor 22, and therefore the amount of the toner remaining in the developing device 2 is inversely proportional to the amount of the toner that has been agitated and transported in the developing device 2.

Figure 6:
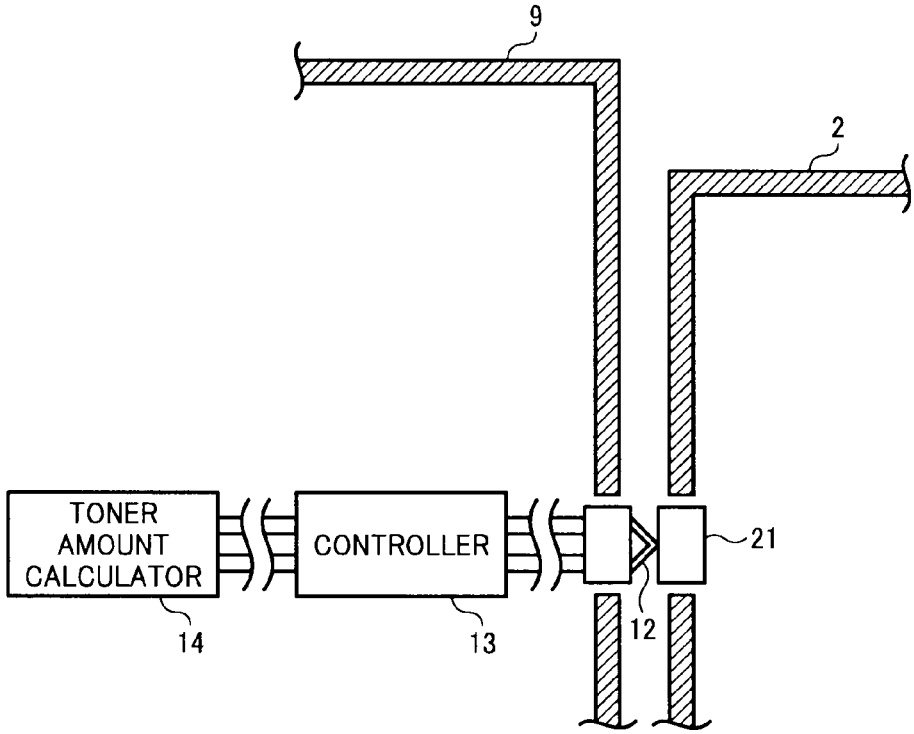
FIG. 6 is a schematic diagram illustrating electric contact provided on the developing device shown in FIG. 4 and its connection to the image forming apparatus shown in FIG. 2.

Therefore, as shown in FIG. 6, the image forming apparatus further includes a toner amount calculator 14 serving as a developer amount detector to detect an amount of the toner remaining in each developing device 2 (hereinafter "remaining toner amount"), and the developing device 2 further includes an electric contact 21 that is electrically conductive with the toner amount calculator 14. When the developing device 2 is attached to the image forming apparatus, the electric contact 21 faces a terminal 12 provided on the frame structure 9 and connected to the controller 13 of the image forming apparatus. The controller 13 is connected to the toner amount calculator 14.

As the toner amount calculator 14 is provided not in the developing devices 2 but in the main body of the image forming apparatus, the cost of the image forming apparatus can be lower compared with a case in which the toner amount calculator 14 is provided in the developing devices 2 that are consumables.

In the present embodiment, the amount of toner consumed to develop one dot of the electrostatic latent image formed on the photoreceptor 22 is preliminarily obtained in a test run. For example, when used of a new developing device 2 is started, counting of the number of dots of the exposure light the writing unit 70 directed to the corresponding photoreceptor 22 is started, and the amount of toner consumed in each developing units 2 is calculated based on the accumulated number of dots of the exposure light. Thus, the remaining toner amount in the developing device 2 is calculated based on the number of dots of exposure light directed to the photoreceptor 22 by the writing unit 70.

Next, a control system of the image forming apparatus according to the present embodiment is described below with reference to a block diagram shown in FIG. 7.

Figure 7:
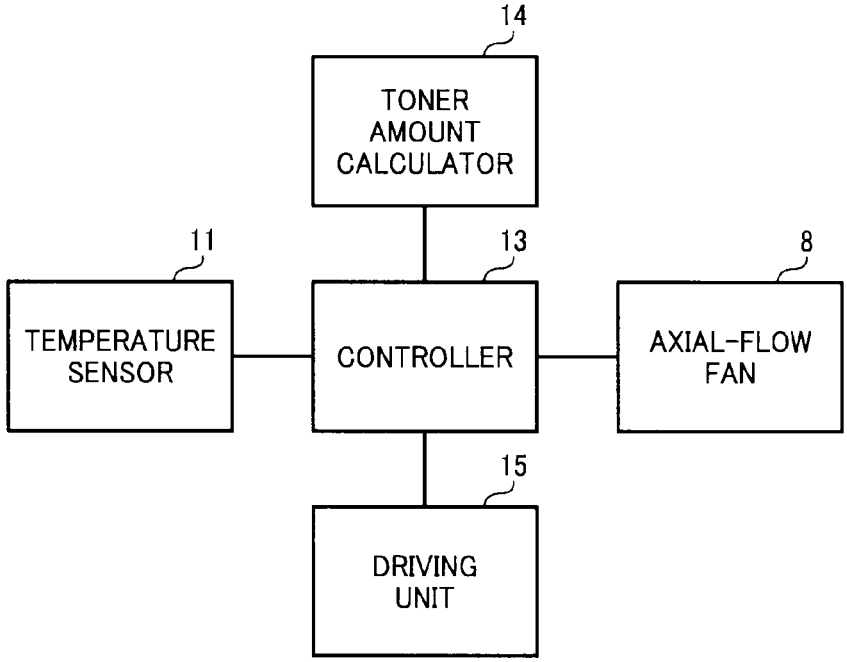
FIG. 7 is a block diagram illustrating a control system of the image forming apparatus shown in FIG. 2.

As shown in FIG. 7, in the present embodiment, the axial-flow fans 8*a* and 8*b* are connected to the controller 13 and are controlled thereby. Further, a driving unit 15 to drive the developing devices 2 is connected to the controller 13. The controller 13 controls driving of the axial-flow fans 8*a* and 8*b* based on the remaining toner amount, ambient temperature detected by the temperature sensor 11, and a temperature count value described below.

The controller 13 includes a time count unit that can be a clock or timer, and a count calculation unit that can be a counter. The clock measures both an image formation time, which is a time period during which a driving motor of the driving unit 15 drives the developing roller 24, and the like of the developing device 2 to rotate (hereinafter "driving time of the driving unit 15"), and as a standby time, which is a time period during which the driving motor is not activated (hereinafter "non-driving time of the driving unit 15"). The count calculation unit of the controller 13 calculates the temperature count value that represents temperature inside the image forming apparatus.

More specifically, during the image formation time, the temperature count value is incremented at a first predetermined or given rate to respond to an increase in temperature inside the image forming apparatus and is decremented at a second predetermined or given rate to respond to a decrease in the temperature inside the image forming apparatus. In the present embodiment, the temperature count value is incremented by 2 for each second during the image formation time and is decremented by 3 for each second during the standby time.

It is to be noted that the temperature inside the image forming apparatus means temperature around the developing devices 2.

When the temperature count value thus calculated is less than 0 or greater than 5000, the temperature count value is corrected to 0 and 5000, respectively. The temperature count value 0 imitates a state in which the temperature inside the image forming apparatus is substantially similar to the ambient temperature and will not fall further. That is, keeping the temperature count value equal to or greater than 0 can make the temperature count value dovetail with a fact that the temperature inside the image forming apparatus decreases to a constant temperature when the image forming apparatus has been unused for a sufficiently long time period.

Similarly, the temperature count value 5000 imitates a state in which the temperature inside the image forming apparatus is kept at a certain temperature and will not rise further.

When temperature inside the image forming apparatus is represented by the above-described temperature count value, it is not necessary to provide a temperature sensor inside the image forming apparatus to detect temperature therein, and thus cost of the image forming apparatus can be lower compared with a case in which such a temperature sensor is provided on or close to the developing device 2. Needless to say, alternatively, temperature inside the image forming apparatus can be detected with such a temperature sensor although the cost increases accordingly.

An example of control of the image forming apparatus according to the present embodiment performed by the controller 13 is described below with reference to a flowchart shown in FIG. 8.

In the present embodiment, the controller 13 sets the cooling mode of the axial-flow fans 8*a* and 8*b* according to ambient temperature, an estimated temperature inside the image forming apparatus, and the amount of the toner remaining in the developing device 2.

Figure 8:
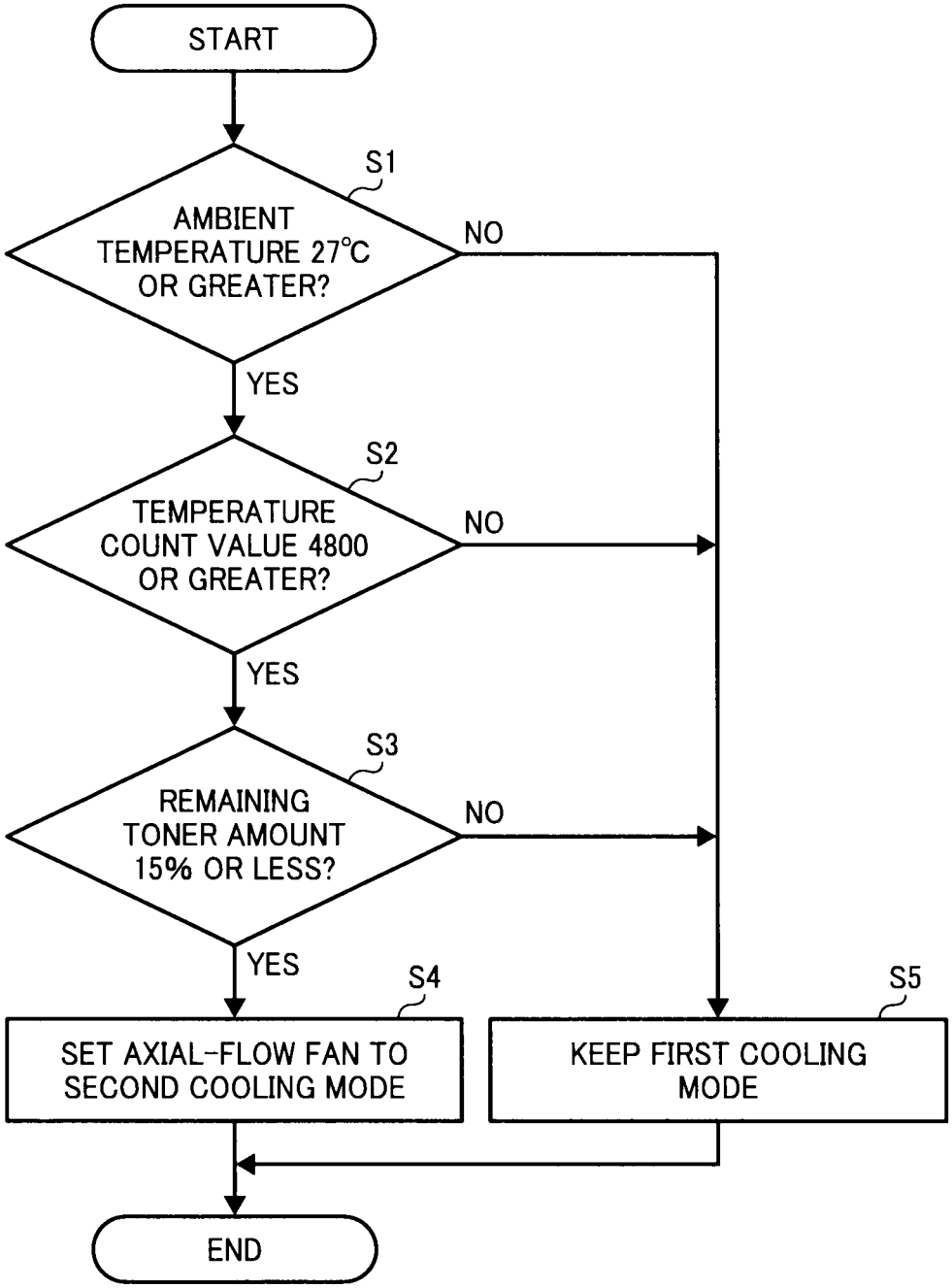
FIG. 8 is a flowchart of an example of control of the image forming apparatus according to an illustrative embodiment.

Referring to FIG. 8, at S1 the controller 13 checks whether or not ambient temperature is equal to or greater than a predetermined or given temperature, for example, 27° C. When the ambient temperature is lower than the predetermined temperature (NO at S1), the controller 13 operates the axial-flow fans 8*a* and 8*b* in the first cooling mode.

By contrast, when the ambient temperature is not lower than the predetermined temperature (YES at S1), at S2 the controller 13 checks whether or not the temperature count value is equal to or greater than a predetermined or given value, for example, 4800. When the temperature count value is less than the predetermined value (NO at S2), the first cooling mode is kept.

By contrast, when the temperature count value is not less than the predetermined value (YES at S2), at S3 the controller 13 checks whether or not the remaining toner amount is not greater than a predetermined or given percentage, for example, 15%, of a maximum storage amount of the toner in the developing device 2.

When the remaining toner amount is greater than the predetermined percentage of the maximum storage amount (NO at S3), the axial-flow fans 8*a* and 8*b* are still kept at the first cooling mode.

By contrast, when the remaining toner amount is not greater than the predetermined percentage of the maximum storage amount (YES at S3), at S4 the axial-flow fans 8*a* and 8*b* are set to a second cooling mode in which the axial-flow fans 8*a* and 8*b* rotate at the full velocity, for example, 4500 rpm.

It is to be noted that, in the present embodiment, when the amount of toner remaining in at least one of the developing devices 2Y, 2M, 2C, and 2K is the predetermined percentage or less at S3, both axial-flow fans 8*a* and 8*b* can be set to the second cooling mode.

As described above, in the present embodiment, the axial-flow fans 8*a* and 8*b* are set to the second cooling mode only when all three conditions: (1) the remaining toner amount is not greater than the predetermined percentage (e.g. 15%) of the maximum storage amount, (2) ambient temperature is not lower than the predetermined temperature (e.g. 27° C.), and (3) the temperature count value is not less than the predetermined value (e.g. 4800), are satisfied. That is, the axial-flow fans 8*a* and 8*b* rotate at a higher velocity that in the present embodiment is the full velocity (e.g. 4500 rpm) when these conditions are satisfied.

By contrast, the axial-flow fans 8*a* and 8*b* are controlled to operate in the first cooling mode to rotate at a lower velocity that in the present embodiment is about half the full velocity (e.g. 4200 rpm) when at least one of the above-described conditions is not satisfied.

Thus, noise of as well as energy consumed by the axial-flow fans 8*a* and 8*b* are not unnecessarily large because the axial-flow fans 8*a* and 8*b* are set to rotate at the higher velocity only when the above-described three conditions are satisfied, which is likely to increase the temperature around the developing devices 2.

Control of the axial-flow fans according to a variation of the above-described embodiment is described below.

An image forming apparatus according to this variation has a configuration similar to that of the image forming apparatus shown in FIGS. 1 through 7. In this variation, because the remaining toner amount is not necessarily similar in the respective developing units 2Y, 2M, 2C, and 2K, the axial-flow fans 8*a* and 8*b* shown in FIGS. 2 and 3 are controlled independently, which is different from the above-described embodiment.

More specifically, in this variation, the controller 13 sets the axial-flow fan 8*a*, which is close to the developing device 2K and 2C, to the second cooling mode to rotate at the higher velocity when all three conditions: (1A) the remaining toner amount in at least one of the developing device 2K and 2C is not greater than the predetermined percentage (e.g. 15%) of the maximum storage amount, (2) ambient temperature is not lower than the predetermined temperature (e.g. 27° C.), and (3) the temperature count value is not less than the predetermined value (e.g. 4800), are satisfied. The remaining toner amount is calculated by the toner amount calculator 14 shown in FIGS. 6 and 7.

Similarly, the axial-flow fan 8*b*, which is close to the developing device 2Y and 2M, is controlled to operate at the higher velocity when the above-described conditions 2 and 3 as well as a new condition (1B), in which the remaining toner amount in at least one of the developing device 2Y and 2M is not greater than the predetermined percentage (e.g. 15%) of the maximum storage amount, are satisfied.

Similarly to the above-described embodiment, when at least one of the three conditions is not satisfied, each of the axial-flow fans 8*a* and 8*b* is set to the first cooling mode to rotate at the lower velocity.

As described above, in this variation, when one of the developing devices 2 is under such conditions that are likely to increase the temperature of the developing device 2, only the axial-flow fan 8*a* or 8*b* that is close to that developing device 2 can be rotated at the higher velocity. Therefore, noise of as well as energy consumed by the axial-flow fans 8*a* and 8*b* can be reduced.

Control of the axial-flow fans according to another illustrative embodiment of the present invention is described below with reference to FIGS. 9 and 10. An image forming apparatus according to this embodiment has a configuration similar to that of the image forming apparatus shown in FIGS. 1 through 7.

Figure 9:
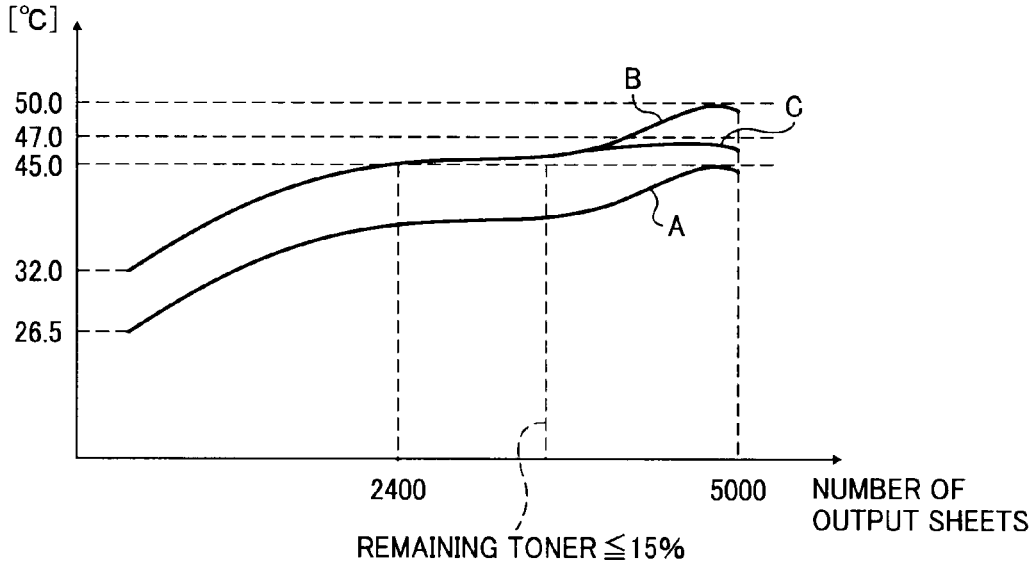
FIG. 9 is a graph illustrating changes in temperature around the developing device during continuous image formation with an image ratio of 5%.
Figure 10:
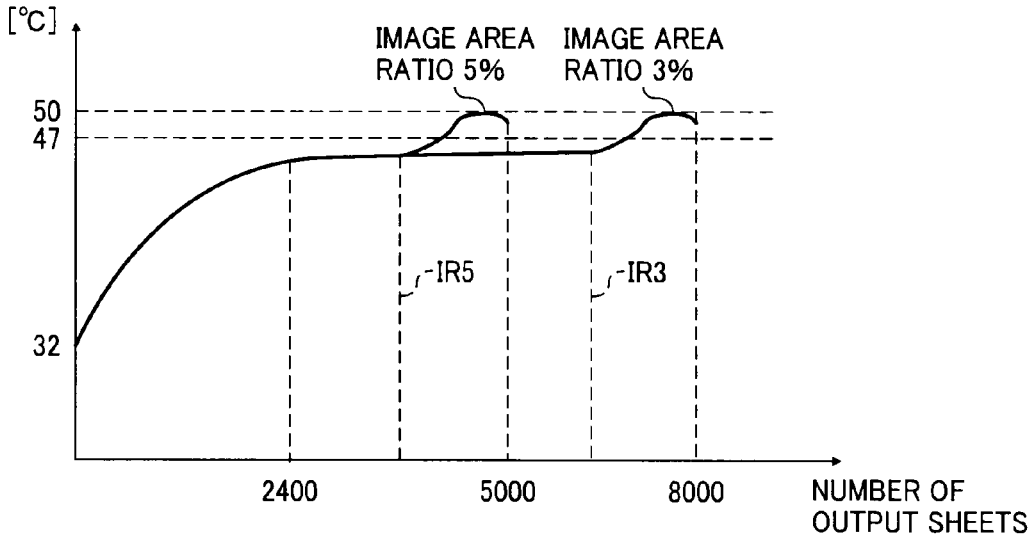
FIG. 10 is a graph illustrating changes in temperature around the developing device when image formation was continuously performed with an image ratio of 3% and with an image ratio of 5%.

FIGS. 9 and 10 are graphs illustrating changes in the temperature around developing device 2 obtained in experiments in which image formation was performed continuously under conditions described below. In each of FIGS. 9 and 10, a vertical axis represents the temperature around the developing device 2, a horizontal axis represents the number of sheets on which images were formed during continuous image formation (hereinafter "output sheets").

The results shown in FIG. 9 were obtained through continuous image formation with an image area ratio of 5% under the following different conditions. (A) Ambient temperature was 26.5° C., and the axial-flow fans 8*a* and 8*b* rotated at the lower velocity (half velocity); (B) ambient temperature was 32° C., and the axial-flow fans 8*a* and 8*b* rotated at the lower velocity; and (C) ambient temperature was 32° C., and the rotation frequency of the axial-flow fans 8*a* and 8*b* was changed from the lower velocity to the higher velocity (full velocity) when the remaining toner amount was 15% or less of the maximum storage amount.

In FIG. 9, lines A, B, and C represent results obtained under the condition A, the condition B, and the condition C, respectively.

It is to be noted that, although a temperature sensor was disposed close to the developing device 2 to detect the temperature around the developing device 2 in the experiment, such a temperature sensor is not necessary in standard image formation because, also in the present embodiment, the controller 13 shown in FIG. 7 counts the temperature count value representing the temperature inside the image forming apparatus.

As represented by line A shown in FIG. 9, under the ambient temperature of 26.5° C., the temperature around the developing device 2 increased due to frictional heat between the developing roller 24 and the supply roller 25, shown in FIG. 4, that rotate in an identical direction while contacting each other as described above. Then, the temperature was substantially constant after the number of the output sheets reached 2400, at which the temperature count value was 4800.

Therefore, the temperature count value 4800 or greater represents a temperature close to a predetermined temperature at which the temperature around the developing device 2 is kept constant or substantially constant. When the image formation was further continued from this state, the temperature around the developing device 2 was kept substantially constant until the remaining toner amount decreased to 15% or less. When the remaining toner amount was 15% or less, the temperature around the developing device 2 reached 45° C. This is because, in such a state, the gap between the shafts (24*a*, 25*a*, and 32*a*) of the rotary members (24, 25, and 32) and the respective bearings (29, 30, and 31) are clogged with the developer, and the developer serves as resistance between the shaft and the bearing, generating frictional heat therebetween.

Here, the increase in the temperature around the developing device 2 is due not to the number of the output sheet but to the remaining toner amount in the developing device 2, which is described in further detail below with reference to the graph shown in FIG. 10.

The graph shown in FIG. 10 includes results in both when image area ratio was 3% and when image area ratio was 5%. In both cases, ambient temperature was 32° C. In FIG. 10, reference characters IR3 and IR5 respectively represent time points when the remaining toner amount decreased to 15% in the respective cases in which image area ratio was 3% and 5%.

As shown in FIG. 10, when image formation was continuously performed with an image area ratio of 3% under ambient temperature of 32° C., the temperature around developing device 2 increased after the remaining toner amount decreased to 15% similarly to the case in which the image area ratio was 5%.

In other words, the amount of toner adhering to the bearing 29, 30, and/or 31 in the developing device 2 depends on the amount of toner that has been consumed. While the amount of toner adhering to the bearing 29, 30, and/or 31 is relatively small, it does not affect the temperature inside the image forming apparatus significantly. However, when the remaining toner amount is 15% or less, as has been noted above, a relatively large amount of toner has already been agitated and transported in the developing device 2, and accordingly, the amount of toner accumulated on the bearing can be relatively large. In such a state, the toner serves as resistance between the shaft and the bearing, generating frictional heat therebetween, which increase the temperature inside the developing device 2, especially in an area close to the bearing.

Referring to FIG. 10, when the temperature around the developing device 2 exceeds 47° C. due to the above-described temperature increase inside the developing device 2, the toner is likely to be fused to firmly adhere to the photoreceptor 22 disposed close to the developing device 2, which degrades image quality and reduces the life of the photoreceptor 22. Therefore, it is preferable to keep the temperature around the developing device 2 at not more than 47° C. in this example. The precise temperature can be determined depending on characteristics of the developer.

However, as represented by line B shown in FIG. 9, under an embedment temperature of 32° C., although the temperature around the developing device 2 was kept substantially constant from when the number of output sheets reached 2400 until the remaining toner amount decreased to 15%, the temperature around the developing device 2 increased above 47° C. when image formation was continued until the remaining toner amount decreased to 15% or less. In this experiment, the temperature around the developing device 2 increased up to 50° C.

Therefore, in the present embodiment, when ambient temperature is 32° C. or higher, the rotation frequency of the axial-flow fans 8*a* and 8*b* is set to the higher velocity (full velocity) so as to keep the temperature around the developing device 2 at 47° C. or lower, and thus maintaining sufficiently high image quality.

Additionally, because the rotation frequency of the axial-flow fans 8*a* and 8*b* is set to the higher velocity only when the temperature around the developing device 2 is likely to increase, noise of as well as energy consumed by the axial-flow fans 8*a* and 8*b* can be reduced similarly to the embodiment described above.

Control of the axial-flow fans according to another illustrative embodiment of the present invention is described below. Similarly to the above-described embodiment, an image forming apparatus according to this embodiment has a configuration similar to that of the image forming apparatus shown in FIGS. 1 through 7.

In the present embodiment, the rotation frequency of the axial-flow fans 8*a* and 8*b* is increased in multiple semi-continuous steps according to the amount of the toner remaining in the developing device 2, rather than just the tow modes as in the above-described embodiments.

The amount of toner adhering to the bearings 29, 30, and 31 shown in FIG. 5 of the developing device 2 depends on a time period during which the toner is agitated and transported in image formation because the toner accumulates on the bearings 29, 30, and 31 over time while the toner is agitated and transported in the developing device 2. Thus, it can be considered that a relatively large amount of toner accumulates on the bearing 29, 30, and 31 about when the toner in the developing device 2 is used up.

Therefore, a degree of the toner adhering to the bearings 29, 30, and 31 can be estimated based on the detection result generated by the toner amount calculator 14.

Therefore, in the present embodiment, the controller 13 increases the cooling power, that is, rotation frequency, of the axial-flow fans 8*a* and 8*b* step-by-step according to the detection result generated by the toner amount calculator 14. With this control, the cooling power of the axial-flow fans 8*a* and 8*b* can be set to a proper power to prevent or reduce an excessive increase in the temperature around the developing device 2 due to friction between the bearings 29, 30, and 31 and the respective shafts 24*a*, 25*a*, and 32*a*.

Additionally, neither noise of nor energy consumed by the axial-flow fans 8*a* and 8*b* is unnecessarily large because rotation frequency of the axial-flow fans 8*a* and 8*b* is increased step-by-step.

Combinations of the remaining toner amount and rotation frequency of the axial-flow fans 8*a* and 8*b* to be increased step-by-step depend on the configuration of the developing device 2 and/or an extent to which the noise and/or energy consumption is reduced. Therefore, such combinations can be determined by observing temperature increase in the developing devices 2 as well as cooling performance of the cooling devices (axial-flow fans 8*a* and 8*b*) through an experiment.

Further, when the rotation frequency of the axial-flow fans 8*a* and 8*b* is set considering ambient temperature and/or the temperature inside the image forming apparatus in addition to the remaining toner amount as in the embodiment described above with reference to FIG. 8, the cooling performance can be set more property under such conditions that are likely to increase the temperature around the developing device 2.

As described above, in an illustrative embodiment of the present invention, the image forming apparatus includes the photoreceptor 22 serving as the latent image carrier, the wiring unit 70 serving as the latent image forming unit, at least one developing device 2 containing developer including toner to develop the latent image, and the axial-flow fans 8*a* and 8*b* serving as the cooling mechanism including at least one cooling device to cool the developing device 2.

The developing device 2 includes, as the rotary members, the developing roller 24, the supply roller 25, and the agitation and transport screw 32 that are rotationally supported by the respective bearings 29, 30, and 31. New developer is not supplied to the developing device 2 while any developer remains therein. Instead, the developing device 2 is replaced or new developer is supplied thereto after all or substantially all the developer preliminarily contained therein is consumed.

The image forming apparatus further includes the toner amount calculator 14 and the controller 13. The toner amount calculator 14 serves as the developer amount detector to detect an amount of the toner remaining in each developing device 2 after use of that developing device 2 in which a predetermined amount of developer is preliminarily contained is started. The controller 13 serves as the cooling mechanism controller that changes the cooling power of the axial-flow fans 8*a* and 8*b* according to a detection result generated by the toner amount calculator 14.

Thus, even when the toner accumulates on the bearings 29, 30, and 31 over time, and accordingly friction heat is generated between the shafts 24*a*, 25*a*, and 32*a* of the rotary members 24, 25, and 32 and the respective bearings 29, 30, and 31, the cooling power of the axial-flow fans 8*a* and 8*b* can be set properly to prevent an excessive increase in the temperature in and around the developing device 2 by changing the cooling power of the axial-flow fans 8*a* and 8*b* according to the remaining toner amount.

Additionally, neither noise of nor energy consumed by the axial-flow fans 8*a* and 8*b* is unnecessarily large while such friction heat is not yet generated because the cooling power of the axial flow fans 8*a* and 8*b* is determined according to the degree of accumulation of the toner on the bearings 29, 30, and 31 that is estimated based on the remaining toner amount.

The controller 13 checks whether or not the first condition, the remaining toner amount detected by the toner amount calculator 14 is not greater than the predetermined amount, is satisfied. Then, the controller 13 operates the axial-flow fans 8*a* and 8*b* in the first cooling mode when the first condition is not satisfied and in the second cooling mode whose cooling power is higher than that of the first cooling mode when first condition is satisfied.

When the image forming apparatus includes multiple developing devices 2, the remaining toner amount in each developing device 2 can be detected, and the controller 13 can increase the cooling power of the cooling mechanism when the remaining toner amount in at least one of the multiple developing devices 2 is not greater than the predetermined amount. The cooling power of the axial-flow fans 8*a* and 8*b* can be easily increased by increasing their rotation frequency.

Alternatively, the controller 13 increases the cooling power of the axial-flow fans 8*a* and 8*b* step-by-step as the remaining toner amount decreases so that the cooling power can match an increase in the temperature around the developing device 2, that is, the degree of accumulation of the toner on the bearings 29, 30, and 31.

The image forming apparatus can further include the temperature sensor 11 to detect ambient temperature, and the controller 13 can further checks whether or not the second condition, ambient temperature is not lower than the predetermined temperature (e.g. 27° C.), is satisfied. Then, the controller 13 can set the axial-flow fans 8*a* and 8*b* to the second cooling mode only when both the first condition and the second condition are satisfied, otherwise, sets the axial-flow fans 8*a* and 8*b* to the first cooling mode. Thus, the noise of and energy consumed by the axial-flow fans 8*a* and 8*b* can be further reduced.

Further, controller 13 can measure an image formation time period as well as a standby time period, and calculate a temperature count value representing the temperature inside the image forming apparatus based on those time periods. Thus, the controller 13 can also serve as the time count unit as well as the count calculation unit.

In this case, the controller 13 can check whether or not the third condition, the temperature count value is not less than the predetermined value (e.g. 4800), is satisfied. Then, the controller 13 can set the axial-flow fans 8*a* and 8*b* to the second cooling mode only when both the first condition and the third condition are satisfied, otherwise, sets the axial-flow fans 8*a* and 8*b* to the first cooling mode.

Thus, the noise of and energy consumed by the axial-flow fans 8*a* and 8*b* can be further reduced. Additionally, as the temperature inside the image forming apparatus can be detected without a temperature sensor, the cost of the image forming apparatus can be relatively low.

Further, because the driving time and the non-driving time of the driving unit 15 is measured as the image formation time period and as the standby time period, respectively, the image formation time period as well as the standby time period can be measured relatively accurately.

Alternatively, the controller 13 can set the axial-flow fans 8*a* and 8*b* to the second cooling mode only when all the first condition, the second condition, and the third condition are satisfied, otherwise, sets the axial-flow fans 8*a* and 8*b* to the first cooling mode.

Additionally, in the above-described embodiment, the image forming apparatus includes multiple developing devices 2Y, 2M, 2C, and 2K divided into at least two groups (2Y and 2M; and 2C and 2K), and multiple axial-flow fans 8*a* and 8*b* each of which cools the developing devices 2Y and 2M, or 2C and 2K, that belong to the different groups. The remaining toner amount in at least one developing device 2 in each group is detected, and the axial-flow fans 8*a* and 8*b* are separately controlled. Thus, controller 13 can set the cooling power of one of the multiple cooling devices that cools the developing device 2 to be cooled to the second cooling mode.

Further, the present invention can be embodied as a control method for the image forming apparatus described above. The control method includes detecting an amount of the toner remaining in the developing device 2, and setting the cooling power of the axial-flow fans 8*a* and 8*b* according to a detected amount of the developer remaining in the developing device 2.

In the step of setting the cooling power of the axial-flow fans 8*a* and 8*b*, the cooling power is set to the first cooling mode initially, and then whether or not the first condition is satisfied is checked. When the first condition is satisfied, the axial-flow fans 8*a* and 8*b* are set to the second cooling mode. As the first cooling mode and the second cooling mode, the velocity of the axial-flow fans 8*a* and 8*b*, serving as the cooling devices, is set to different velocities.

Alternatively, in the step of setting the cooling power of the axial-flow fans 8*a* and 8*b*, the cooling power can be increased step-by-step as the remaining toner amount decreases.

The control method can further include detecting ambient temperature with the temperature sensor 11.

The control method can further includes measuring an image formation time period (driving time of the driving unit 15) as well as a standby time period (non-driving time of the driving unit 15), and calculating a temperature count value representing a temperature inside the image forming apparatus based on the image formation time period and the standby time period.

In the step of calculating the temperature count value, the temperature count value is incremented at the first predetermined rate (e.g., 2 for each second) during the image formation time period and decremented at the second predetermined rate (e.g., 3 for each second) during the standby time period, and the temperature count value is constantly set to a value equal to or greater than 0.

In setting the cooling power of the axial-flow fans 8*a* and 8*b*, wither or not first condition and at least one of the second condition and the third condition can be satisfied is checked.

As can be appreciated by those skilled in the art, the elements of the various embodiment described above can be combined freely.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a latent image carrier;

a latent image forming unit to form an electrostatic latent image on the latent image carrier;

at least one developing device, in each of which a predetermined amount of developer is preliminarily stored, disposed to contact the latent image carrier to develop the latent image on the latent image carrier with the developer, the developing device provided with at least one rotary member whose shaft is rotationally supported by at least one bearing, the developing device not to be supplied with new developer while any developer remains therein;

a cooling mechanism including at least one cooling device disposed close to the developing device to cool the developing device;

a developer amount detector electrically connected to the developing device to detect an amount of the developer remaining in the developing device; and a cooling mechanism controller connected to the cooling mechanism to change a cooling power of the cooling mechanism according to a detection result generated by the developer amount detector, wherein the cooling device is switched between a first cooling mode and a second cooling mode in which a cooling power is greater than a cooling power in the first cooling mode, and the cooling mechanism controller sets the cooling device to the second cooling mode when a first condition that the amount of the developer remaining in the developing device detected by the developer amount detector is equal to or less than a predetermined amount is satisfied; and a temperature sensor connected to the cooling mechanism controller to detect a temperature around the image forming apparatus, wherein the cooling mechanism controller changes the cooling mode of the cooling device from the first cooling mode to the second cooling mode when both the first condition and a second condition that a detected temperature around the image forming apparatus is equal to or higher than a predetermined temperature are satisfied.

2. The image forming apparatus according to claim 1, further comprising:

a time count unit to measure a time period during which image formation is performed as an image formation time period as well as a time period during which image formation is not performed as a standby time period; and a count calculation unit to calculate a temperature count value representing a temperature inside the image forming apparatus based on the image formation time period and the standby time period, wherein the cooling mechanism controller changes the cooling mode of the cooling device from the first cooling mode to the second cooling mode when all of the first condition, the second condition, and a third condition that the calculated temperature count value is equal to or greater than a predetermined value are satisfied.

3. An image forming apparatus comprising:

a latent image carrier;

a latent image forming unit to form an electrostatic latent image on the latent image carrier;

at least one developing device, in each of which a predetermined amount of developer is preliminarily stored, disposed to contact the latent image carrier to develop the latent image on the latent image carrier with the developer, the developing device provided with at least one rotary member whose shaft is rotationally supported by at least one bearing, the developing device not to be supplied with new developer while any developer remains therein;

a cooling mechanism including at least one cooling device disposed close to the developing device to cool the developing device;

a developer amount detector electrically connected to the developing device to detect an amount of the developer remaining in the developing device;

a cooling mechanism controller connected to the cooling mechanism to change a cooling power of the cooling mechanism according to a detection result generated by the developer amount detector, wherein the cooling device is switched between a first cooling mode and a second cooling mode in which a cooling power is greater than a cooling power in the first cooling mode, and the cooling mechanism controller sets the cooling device to the second cooling mode when a first condition that the amount of the developer remaining in the developing device detected by the developer amount detector is equal to or less than a predetermined amount is satisfied;

a time count unit to measure a time period during which image formation is performed as an image formation time period as well as a time period during which image formation is not performed as a standby time period; and a count calculation unit to calculate a temperature count value representing a temperature inside the image forming apparatus based on the image formation time period and the standby time period, wherein the cooling mechanism controller changes the cooling mode of the cooling device from the first cooling mode to the second cooling mode when both the first condition and a third condition that the calculated temperature count value is equal to or greater than a predetermined value are satisfied.

4. The image forming apparatus according to claim 3, further comprising a driving unit to drive the developing device, wherein the time count unit measures a time period during which the driving unit is activated as the image formation time period and a time period during which the driving unit is not activated as the standby time period.

5. The image forming apparatus according to claim 3, wherein the time count unit increments the temperature count value at a first predetermined rate during the image formation time period, decrements the temperature count value at a second predetermined rate different from the first predetermined rate during the standby time period, and constantly sets the temperature count value to a value equal to or greater than 0.

6. A control method for an image forming apparatus, the image forming apparatus comprising a latent image carrier on which a latent image is formed; at least one developing device to develop the latent image with developer contained therein; and a cooling mechanism including at least one cooling device to cool the developing device, the control method comprising the steps of:

detecting an amount of the developer remaining in the developing device; and setting a cooling power of the cooling mechanism according to a detected amount of the developer remaining in the developing device, wherein the step of setting the cooling power of the cooling mechanism according to the detected amount of the developer remaining in the developing device further comprises:

setting a cooling mode of the cooling mechanism to a first cooling mode;

determining whether or not a first condition that the amount of the developer remaining in the developing device detected is equal to or less than a predetermined amount is satisfied; and changing the cooling mode of the cooling mechanism to a second cooling mode in which a cooling power is greater than a cooling power in the first cooling mode when the first condition is satisfied, further comprising:

detecting a temperature around the image forming apparatus; and determining whether or not a second condition that the detected temperature around the image forming apparatus is at a predetermined temperature or higher, wherein the cooling mode of the cooling mechanism is changed to the second cooling mode when both the first condition and the second condition are satisfied.

7. The control method according to claim 6, further comprising:

measuring a time period during which image formation is performed as an image formation time period as well as a time period during which image formation is not performed as a standby time period;

calculating a temperature count value representing a temperature inside the image forming apparatus based on the image formation time period and the standby time period; and determining whether or not a third condition that the calculated temperature count value is equal to or greater than a predetermined value is satisfied, wherein the cooling mode of the cooling device is changed to the second cooling mode when all of the first condition, the second condition, and the third condition are satisfied.

8. A control method for an image forming apparatus, the image forming apparatus comprising a latent image carrier on which a latent image is formed; at least one developing device to develop the latent image with developer contained therein;

and a cooling mechanism including at least one cooling device to cool the developing device, the control method comprising the steps of:

detecting an amount of the developer remaining in the developing device; and setting a cooling power of the cooling mechanism according to a detected amount of the developer remaining in the developing device, wherein the step of setting the cooling power of the cooling mechanism according to the detected amount of the developer remaining in the developing device further comprises:

setting a cooling mode of the cooling mechanism to a first cooling mode;

determining whether or not a first condition that the amount of the developer remaining in the developing device detected is equal to or less than a predetermined amount is satisfied; and changing the cooling mode of the cooling mechanism to a second cooling mode in which a cooling power is greater than a cooling power in the first cooling mode when the first condition is satisfied, further comprising:

measuring a time period during which image formation is performed as an image formation time period as well as a time period during which image formation is not performed as a standby time period;

calculating a temperature count value representing a temperature inside the image forming apparatus based on the image formation time period and the standby time period; and determining whether or not a third condition that the calculated temperature count value is equal to or greater than a predetermined value is satisfied, wherein the cooling mode of the cooling device is changed to the second cooling mode when both the first condition and the third condition are satisfied.

9. The control method according to claim 8, wherein a time period during which a driving unit to drive the developing device is activated is measured as the image formation time period, and a time period during which the driving unit is not activated is measured as the standby time period.

* * * * *